US009086193B2

(12) United States Patent
Alfier et al.

(10) Patent No.: US 9,086,193 B2
(45) Date of Patent: Jul. 21, 2015

(54) LIGHTING DEVICE HAVING OPTICAL ELEMENT CARRYING ELECTRICAL CONTACTS

(71) Applicant: OSRAM GmbH, Munich (DE)

(72) Inventors: Alberto Alfier, Vedelago (IT); Franco Zanon, Cassola (IT)

(73) Assignee: Osram GmbH, Munich (DE)

( * ) Notice: Subject to any disclaimer, the term of this patent is extended or adjusted under 35 U.S.C. 154(b) by 0 days.

(21) Appl. No.: 14/197,264

(22) Filed: Mar. 5, 2014

(65) Prior Publication Data

US 2014/0254159 A1 Sep. 11, 2014

(30) Foreign Application Priority Data

Mar. 11, 2013 (IT) ..... TO2013A0190

(51) Int. Cl.

| | |
|---|---|
| ***F21S 6/00*** | (2006.01) |
| ***F21K 99/00*** | (2010.01) |
| ***F21V 7/22*** | (2006.01) |
| ***F21V 17/12*** | (2006.01) |
| ***F21V 19/00*** | (2006.01) |
| ***F21V 23/06*** | (2006.01) |
| *F21Y 101/02* | (2006.01) |

(52) U.S. Cl.

CPC ... *F21K 9/50* (2013.01); *F21V 7/22* (2013.01); *F21V 17/12* (2013.01); *F21V 19/0035* (2013.01); *F21V 23/06* (2013.01); *F21Y 2101/02* (2013.01)

(58) Field of Classification Search

CPC ..... F21V 7/222; F21V 17/12; F21V 23/06; F21V 19/0035; F21K 9/50; F21Y 2101/02

USPC ..... 362/257, 217.1, 217.05, 241, 247, 362/296.01, 237

See application file for complete search history.

(56) References Cited

U.S. PATENT DOCUMENTS

| | | | | |
|---|---|---|---|---|
| 5,567,036 | A * | 10/1996 | Theobald et al. | 362/485 |
| 2005/0190553 | A1 | 9/2005 | Lynch et al. | |
| 2007/0098334 | A1 | 5/2007 | Chen | |
| 2009/0046469 | A1 | 2/2009 | Yang et al. | |
| 2011/0090691 | A1* | 4/2011 | Markle et al. | 362/249.02 |
| 2011/0242815 | A1* | 10/2011 | Markle et al. | 362/294 |

(Continued)

OTHER PUBLICATIONS

Search Report issued in the corresponding Italian application No. TO2013A0190, dated Nov. 4, 2013, Nov. 3, 2013.

(Continued)

*Primary Examiner* — Anh Mai
*Assistant Examiner* — Glenn Zimmerman

(57) ABSTRACT

A lighting device includes a tray-like housing with a base wall, at least one light radiation source on the base wall of the housing, having electrical contact pads in an opposite position from the base wall of the housing, and a circuit board on the base wall of the housing with electrically conductive lines extending on the face of the board opposite from the base wall of the housing, with respective electrical contact pads placed in positions facing the electrical contact pads of the light radiation source. At least one optical element is provided, with a light input to collect light radiation at the light radiation source and one or more light outputs to project light radiation from the lighting device. The optical element has an electrically non-conductive base wall which urges the light radiation source or sources and the circuit board toward the base wall of the housing.

12 Claims, 4 Drawing Sheets

(56) References Cited

U.S. PATENT DOCUMENTS

| | | | | |
|---|---|---|---|---|
| 2012/0051045 | A1* | 3/2012 | Harbers et al. | 362/235 |
| 2012/0051068 | A1* | 3/2012 | Pelton et al. | 362/373 |
| 2014/0063814 | A1* | 3/2014 | McGowan et al. | 362/308 |
| 2014/0085887 | A1 | 3/2014 | Alfier et al. | |

OTHER PUBLICATIONS

Search Report issued in the corresponding EP application No. 14156877.4, dated May 19, 2014.

* cited by examiner

LIGHTING DEVICE HAVING OPTICAL ELEMENT CARRYING ELECTRICAL CONTACTS

RELATED APPLICATION

This application claims priority to Italian Patent Application Serial No. TO2013A000190, which was filed Mar. 11, 2013, and is incorporated herein by reference in its entirety.

TECHNICAL FIELD

Various embodiments relate to lighting devices.

Various embodiments may relate to lighting devices using LED sources as light radiation sources.

BACKGROUND

Lighting modules, such as those for street lighting, using solid state light radiation sources ("Solid State Lighting", or SSL) can be considered competitive in that they simultaneously meet various requirements in terms of robustness relating to the context of their use "in the field", namely:

resistance to electrical overstress (EOS), resistance to thermal dissipation, long service life, and mechanical strength.

The first aspect mentioned above is related to the phenomena of electric overload: proper electrical insulation is important not only for avoiding the harm caused by electrostatic discharge (ESD) events during the assembly of the lighting module or of the corresponding device, but also in relation to electrical overload events such as those caused by lightning.

The second aspect is related to the thermal dissipation properties of the housing which encloses the module, and may require a considerable part of the lighting device to be made of a metal material (such as aluminum) so that it has a certain degree of weight. If the module has low thermal resistance between the connection points of the light radiation sources (such as LEDs) and the thermal dissipation surface of the module, the corresponding device may also have a rather high thermal resistance between the surface in contact with the module and the external environment.

The third aspect relates to the faults that may arise in the module even without any causation by a specific external event. These events may have a negative effect on the service life, either in the form of "soft" faults (the light flux falls below a certain threshold level, without total loss of light emission), or in the form of "hard" faults (the radiation source ceases to emit radiation and acts as either an open or a closed contact).

The fourth aspect relates to the mechanical strength in the conditions of use in the field, and requires the module to meet certain requirements in terms of mechanical performance, in exterior applications for example (resistance to vibration, impact, and the like).

In various designs of lighting devices, of the solid state type for example, the four aspects mentioned above tend to create opposing constraints.

For example, electrical insulation may be achieved by using mechanically robust substrates, with the risk of adversely affecting the thermal dissipation characteristics and increasing the possibility of hard faults; on the other hand, materials capable of providing electrical insulation together with good thermal dissipation characteristics while also reducing the risks of hard faults may be mechanically fragile.

For example, it is possible to use substrates of the PCB (printed circuit board) type, in other words those resembling printed circuits, with metal cores, using high luminosity LEDs as the light radiation sources. Solutions of this kind have good characteristics in terms of thermal dissipation, electrical insulation and mechanical robustness. However, they may have critical aspects due to the differences in the coefficient of thermal expansion (CTE) that may be encountered, for example, between the ceramic packages of high luminosity LEDs and materials such as aluminum (15-20 ppm/° C.). In all cases, there is a risk of increasing the possibility of hard faults in the soldering points between the package and the LEDs and the PCB if the module is subjected to thermal cycles such as those which may occur to a pronounced degree in exterior applications, and the consequent possibility of observing a marked reduction in the service life of the LEDs: for example, as regards the light emission performance (LED lumen maintenance), the specified values of 100 kilohours may fall to values of 20-30 kilohours when measured in the field.

It has been proposed that these problems should be tackled by replacing aluminum with copper, for which the mismatch with the ceramic materials in terms of CTE is lower, at about 10-15 ppm/° C. However, this solution has the drawback of practically doubling the cost compared with solutions in which aluminum is used for making the PCB, which is unacceptable in applications where the cost of the PCB accounts for a significant part of the overall cost of the device.

A performance substantially comparable to that of copper, in terms of the mismatch of the coefficient of thermal expansion (CTE) with respect to packages of ceramic material, can be achieved by using the material known as FR4, although the latter has a low level of thermal dissipation; attempts may be made to counteract this characteristic by providing thermal bridges ("vias") through the PCB, but this has negative effects on the electrical insulation characteristics.

It has also been proposed that PCB substrates of ceramic material should be used, as these can provide high performance in terms of thermal characteristics, electrical insulation and the service life of the module, but this would have adverse effects on the mechanical characteristics, particularly where the possibility of using large PCBs is being considered.

The use of what are known as "Chip On Board" (CoB) products appears more promising, although these products are uncompetitive, at the present time at least, in terms of the lighting density (known as the cost per lumen), while they do not allow a high chip density in the CoB.

It is also possible to consider the use of medium- to low-power LED sources as light radiation sources, thus enabling non-ceramic packages to be used and increasing the reliability of the soldered connections. However, this solution also has the drawback of a high cost per lumen and rather low resistance to possible corrosion by environmental factors (such as sulfuric components).

SUMMARY

Various embodiments overcome the aforementioned drawbacks.

Various embodiments may be based on the provision of at least one element (made in the form of a reflector, for example) which can act simultaneously to provide not only optical functions, but also mechanical and electrical functions, allowing in all cases the use of solid state light radiation sources, such as high luminosity LEDs, as light radiation sources. These sources may be, for example, LEDs which are not mounted in a package but are simply placed on a substrate, for example one resembling a printed circuit board (PCB), fitted in a housing of plastic or metal material.

Various embodiments may be applied to solutions in which the light radiation sources are installed in an area which is sufficiently small to provide adequate properties of mechanical robustness for the support, of the PCB type for example.

In various embodiments, the aforesaid element may have:

one or more reflecting and/or refracting parts or components, capable of acting as secondary optics for the light radiation sources (of the LED type for example), one or more electrical connectors for providing a bridge connection for a board carrying electrical anode and cathode power supply lines for the light radiation sources (LEDs); these components can be embedded in the element or can be made in the form of additional components, for example in the form of an additional PCB with anode and cathode bus lines, mechanical characteristics used to exert adequate pressure on the light source or sources and on the PCB substrate, pressing them against the surface of an element made of metal or plastic material which can act as a heat sink; a power supply circuit board of this type can be made of a material which is advantageous in terms of cost, for example CEM, FR4, or, if appropriate, in the form of flexible PCB modules, of the adhesive type for example.

BRIEF DESCRIPTION OF THE DRAWINGS

In the drawings, like reference characters generally refer to the same parts throughout the different views. The drawings are not necessarily to scale, emphasis instead generally being replaced upon illustrating the principles of the disclosure. In the following description, various embodiments of the disclosure are described with reference to the following drawings, in which.

DETAILED DESCRIPTION

Figure 1:
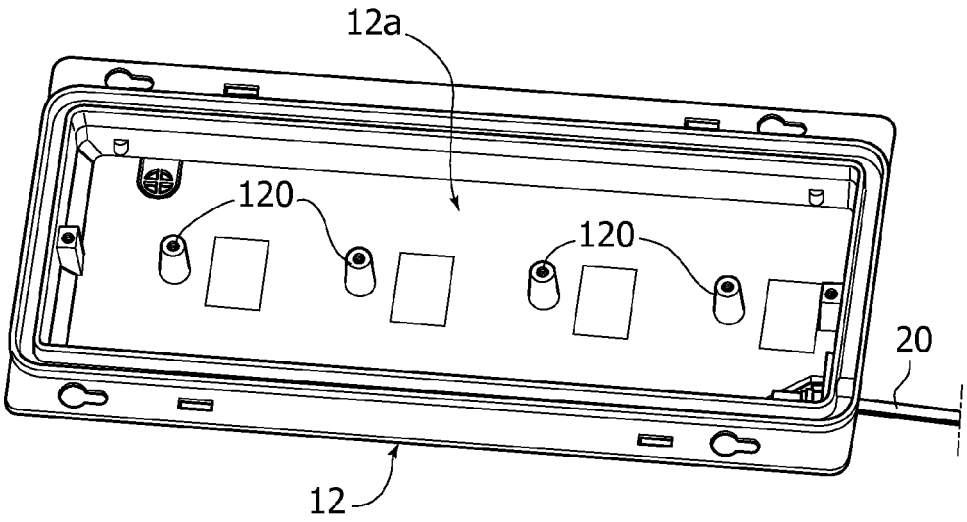
FIGS. 1 to 5 show various components of some embodiments.

The following description illustrates various specific details intended to provide a deeper understanding of various exemplary embodiments. The embodiments may be produced without one or more of the specific details, or with other methods, components, materials, etc. In other cases, known structures, materials or operations are not shown or described in detail, in order to avoid obscuring various aspects of the embodiments.

The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in any suitable way in one or more embodiments.

The references used herein are provided purely for convenience and therefore do not define the scope of protection or the extent of the embodiments.

Various embodiments may relate to a lighting device 10 which can be used, for example, for street lighting applications.

The device 10 can be mounted on a support P such as a pole, a bracket, an overhead line, or the like, according to the procedures currently used in the lighting field.

In various embodiments, the device 10 may be intended for fitting into a containment structure S which in turn is intended to be fastened to the support P and serves to protect the device 10, while also allowing the light radiation emitted by the latter to be projected into the environment. This containment structure S, shown schematically in broken lines in FIG. 7 only, mounted on a support P, may be of any known type. It is therefore unnecessary to give a detailed description in this document, especially since the characteristics of this containment structure are not particularly relevant to the embodiments.

In various embodiments, a lighting device 10 as illustrated may include a tray-like containment housing 12 (of rectangular shape, for example), having a base wall 12*a*.

In various embodiments, one or more light radiation sources 14, of the LED type for example, may be applied to the base wall 12*a* of the housing 12.

In various embodiments, the light radiation sources 14 may be electrically powered through electrical contact pads 14*a* provided, for example, on a plate-like substrate 140 so as to be placed in an opposite position from the base wall 12*a* of the housing 12.

In various embodiments, a circuit board 16, which can be made, for example, by procedures substantially similar to those used for a printed circuit board (PCB), may have electrically conductive tracks (or lines) 160.

In various embodiments, the conductive lines 160 may extend on the opposite face of the board 16 from the base wall 12*a* of the housing 12 between respective electrical connection pads 16*a*.

Figure 6:
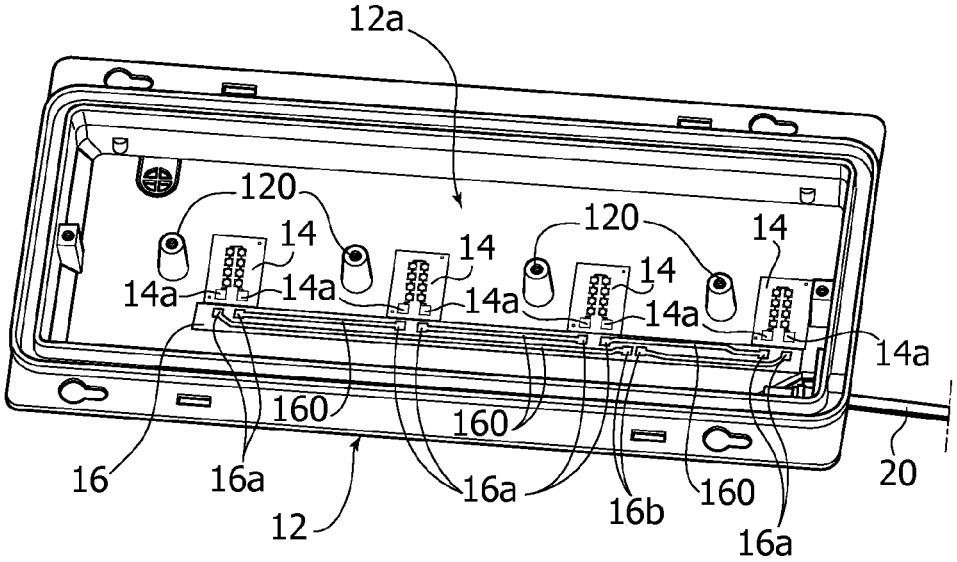
FIGS. 6 and 7 show possibilities for the assembly of some embodiments.
Figure 10:
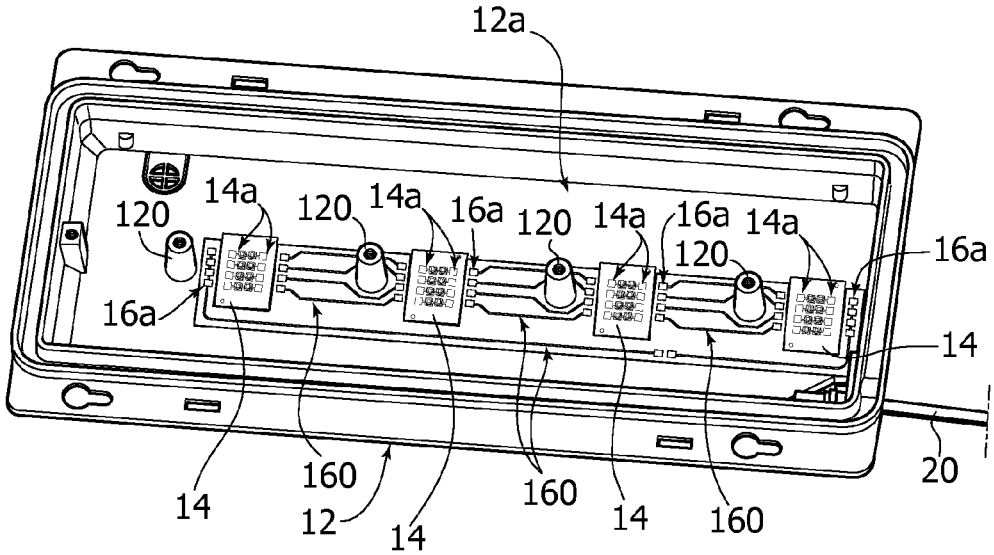

In various embodiments, as shown more clearly in the views of FIGS. 6 and 10, in the assembled device 10 the electrical connection pads 16*a* are placed in a position facing the electrical connection pads 14*a* of the light radiation source or sources 14.

In various embodiments, one or more optical elements 18 operating by reflection and/or refraction may be mounted in the housing 12, each element having at least one input 18*a* and at least one output 18*b* for the light radiation. The input 18*a* can be placed at the light radiation source or at one of the light radiation sources 14 so as to capture the radiation emitted by this source and then guide it toward the output or outputs 18*b*, thus projecting it toward the outside of the lighting device 10.

In various embodiments, the optical element or elements 18 may take the form of one or more reflectors which can be mounted in the housing 12 with the base part 18 of the reflector, or of each reflector, (the part indicated by 18', shown more clearly in the views from below in FIGS. 5 and 11) facing the base wall 12*a* of the housing 12. For example, the base part 18' may be provided with a base wall 180 having an aperture 180*a*, enabling the reflector to be fitted on a stud 120 projecting from the base wall 12*a* of the housing 12.

Thus the base wall 180 (which can be made of an electrically insulating material such as plastic material, as can the whole body of the reflector 18 if required) may rest on the light radiation source or sources 14 and on the circuit board 16 (which extends adjacent to the light source or sources 14), and may press these elements against the base wall 12*a*.

Figure 7:
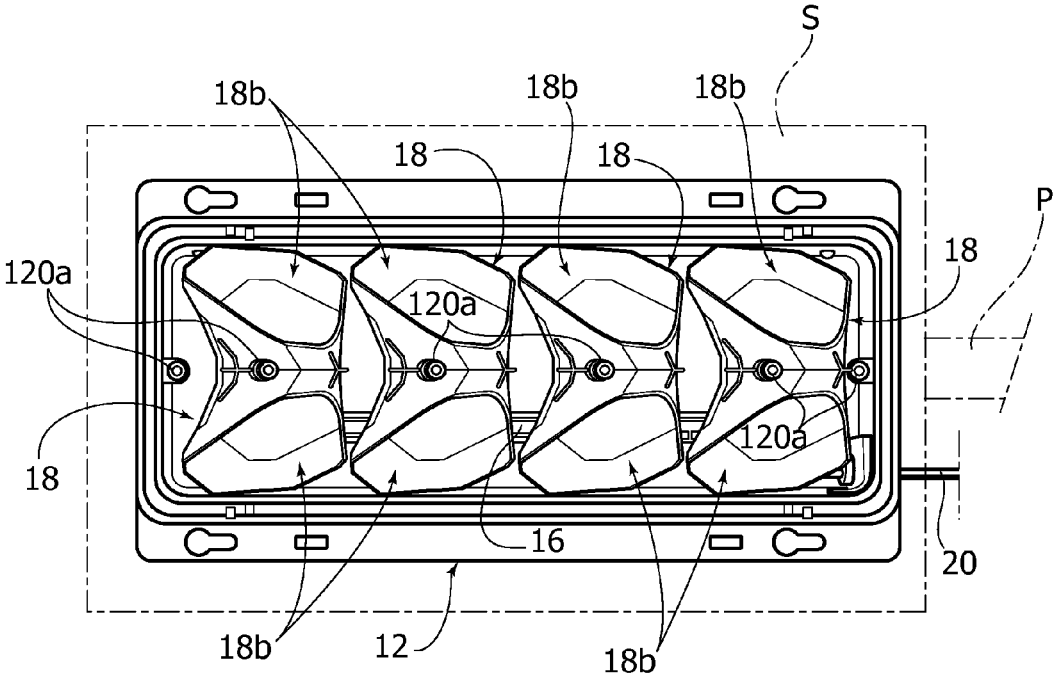

As shown more clearly in the representation in FIG. 7, the reflector or reflectors 18 may be locked in this assembled position by screws 120*a* or similar fastening formations which engage, for example, in respective holes provided in the studs 120.

In various embodiments, the housing 12 (or at least the base wall 12*a* thereof) may be made of a metal material, for example aluminum, that is to say a material having good thermal dissipation characteristics.

In various embodiments, the circuit board 16 can be made by the methods currently used to make printed circuit boards (PCBs).

In various embodiments, the board 16 may be provided with conductive lines or tracks 160 organized so as to form anode and cathode power supply paths, respectively, for the light radiation sources (of the LED type, for example, which is the reason for the reference to the presence of an anode and a cathode), running from two power supply input pads indicated by 16*b*. The power supply input pads 16*b* can receive electrical power from a power supply cable 20 which is shown in FIGS. 1, 6 and 7 only, for reasons of simplicity.

Figure 3:
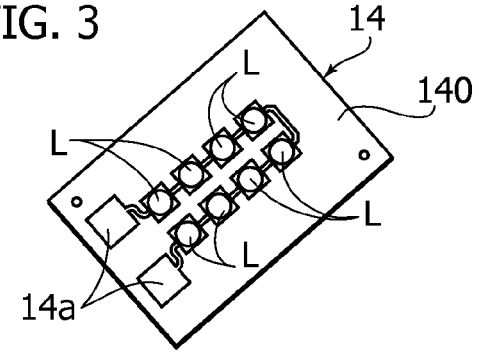
Figure 4:
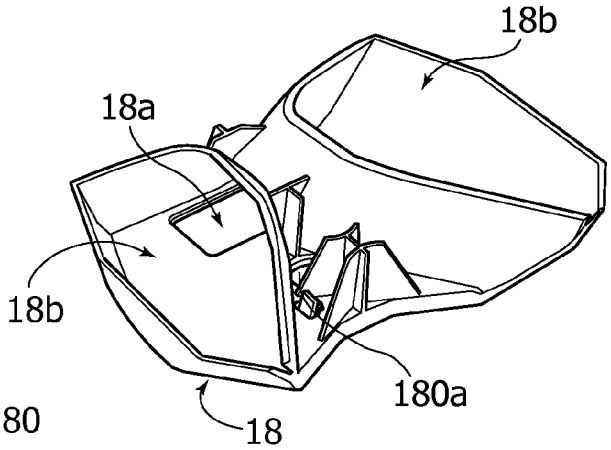

In various embodiments, as shown by way of example in FIG. 3, a plate-like substrate 140 can be used for the sources 14, this substrate being made of ceramic material for example, and having, for example, dimensions of 20×30 mm, carrying, for example, eight LEDs L forming a rectangular array or "cluster" with dimensions of about 10×20 mm, connected in series with each other.

Figure 9:
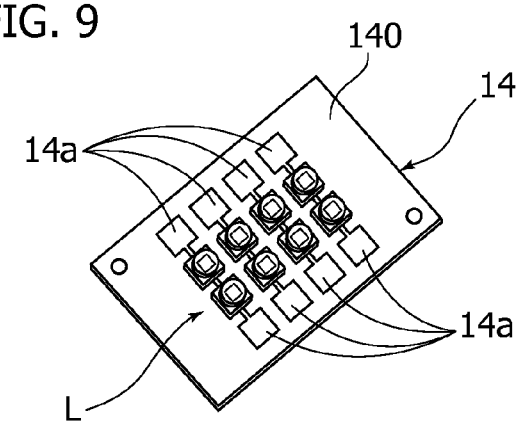

FIG. 9 shows an exemplary embodiment in which a substrate 140 having the same dimensions of 20×30 mm can carry a rectangular cluster with dimensions of 10×20 mm formed by eight LEDs organized in four "strings", each including two LEDs L.

In embodiments such as those shown by way of example in FIG. 3, with all the LEDs connected in series, two pads 14*a*, for the anode and cathode connection respectively, may be present. In embodiments such as those shown by way of example in FIG. 9, each string may have respective connection pads 14*a*, again used for the anode and cathode connection respectively.

In various embodiments, a ceramic material may be used for the substrate 140 of the light radiation sources 14. A plate-like substrate of this type, for example one having dimensions such as those described above, is small enough to provide the typical advantages of ceramic materials, at lower cost, while also being capable of resisting mechanical stresses such as vibration.

In various embodiments, the substrate 140 can be made by a method similar to that used for printed circuit boards (PCBs), for example those with metal cores.

A similar method may be chosen for the circuit board 16; in this case, it is possible to use a PCB structure, using materials such as those known as CEM or FR4, or a flexible module structure of the type commonly known as "flex", which can be applied adhesively to the base wall 12*a* of the housing 12 or applied in other ways.

Figure 2:
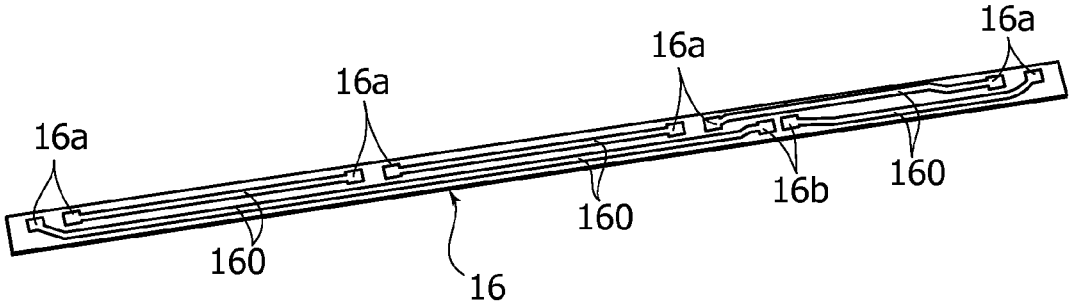

In embodiments such as those shown by way of example in FIGS. 2, 6 and 7, the circuit board 16 takes the form of an elongate element (in practice, a strip) extending along the array of light radiation sources 14 so as to place the pads 16*a* in positions facing the pads 14*a*.

Figure 8:
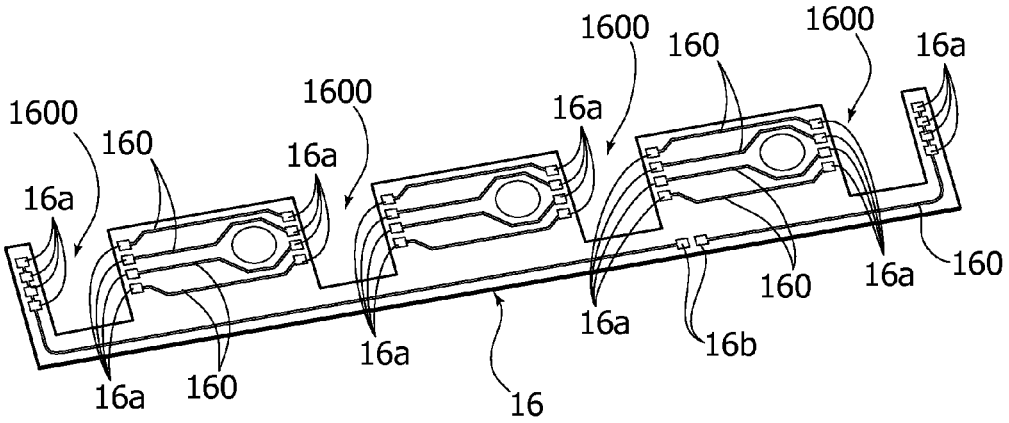
FIGS. 8 to 11 show other components of some embodiments.

In embodiments such as those shown by way of example in FIGS. 8 and 10, the board 16 may be provided with cut-out parts (U-shaped, for example) 1600, in which the light radiation sources are located when these light sources 14 and the circuit board 16 have been applied to the base wall 12*a* of the housing 12, as will be clearer from the view of FIG. 10.

As regards the optical element 18, embodiments such as those shown in the figures (see for example FIG. 7) may provide for the reflector, or each of the reflectors, to have a generally V-shaped configuration (or an inverted saddle shape) such that the input aperture for the radiation 18*a* is located next to a corresponding light radiation source 14 (in practice, at the base of the V-shape) and the output apertures 18*b* are located at the opposite ends of the two branches of the V-shape in a condition of substantial coplanarity with the plane of the opening of the housing 12.

As mentioned in the introductory part of the present description, the optical element, or each of the optical elements shown here by way of example as the reflector 18 can provide a plurality of functions.

For example, in the assembled condition of FIG. 7, the element or each of the elements 18 can provide a mechanical assembly function by pressing the light radiation source or sources 14 together with the circuit board 16 against the base wall 12*a* of the housing 12 so as to provide efficient heat exchange.

Figure 5:
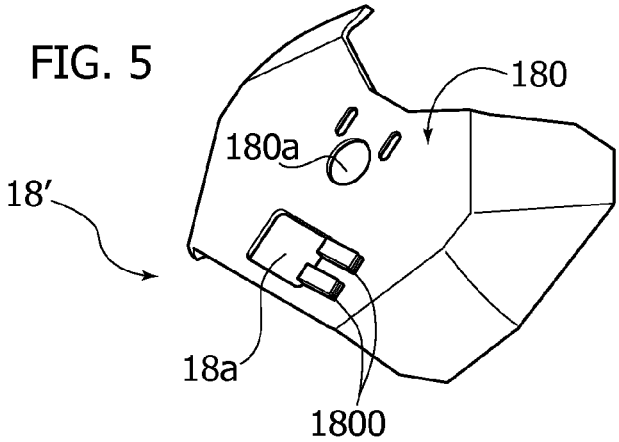
Figure 11:
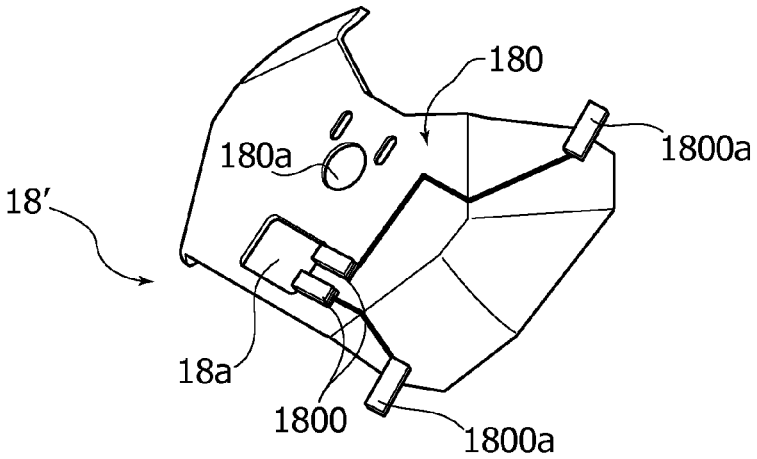

As will be clear from the views of FIGS. 5 and 11, in various embodiments the base wall 180 of the element or each of the elements 18 may carry electrical contacts 1800, in the form of metal pads for example, each of which, when the respective element 18 is mounted in the housing 12 of the device (see FIG. 7), forms a connecting bridge between two connection pads 14*a*, 16*a* of the light radiation source or of one of the light radiation sources 14 and of the circuit board 16 respectively.

In embodiments such as those shown by way of example in FIG. 11, the contacts 1800 may be connected to further electrical contacts 1800*a* capable of providing a function of electrical connection, if required, to an external power supply cable (20 in FIGS. 1, 6 and 7) or providing possibilities of connection between different reflectors.

In addition to these mechanical and electrical functions, the element or each of the elements 18 may also provide its own optical function by guiding the light radiation generated by the source 14 associated with the element toward the outside of the device 10 (by reflection and/or refraction).

In various embodiments, the element 18 may be made in the form of a reflector with a body (a hollow body, for example) made of molded plastic material.

In various embodiments, the component 18 may be made with a body having:

- a base part 18', provided with the aperture 18*a* having a fixed size and shape, and
- an upper part, provided with the output apertures 18*b*, the sizes and shapes (and orientation) of which vary according to the lighting requirements to be met.

In this respect it is possible to adopt the solution described in the industrial patent application TO2012A000836 submitted by the present applicants.

In various embodiments, the body of the element 18 may be made of a material and/or treated with a material having a high level of reflectivity to light radiation (for example, the inner surface of the reflector may be aluminum-coated).

The embodiments described here by way of example may be varied in respect of numerous aspects, such as those shown below (the list given here is provided by way of non-limiting example):

- the number of light radiation sources 14 and/or the number of light radiation emitters L (of the LED type for example) present within these sources,
- the type of radiation sources/emitters used, for example LEDs of the packaged or unpackaged type,
- the sizes and shapes of the substrates 140 of the light radiation source or sources,
- the sizes, shapes, composition and organization (series, parallel, or combined series and parallel connection) of the clusters of emitters included in the light radiation source or sources 14, the number of optical elements 18, the solutions used to secure the element or elements 18 to the housing 12, the choice of the component materials, and/or the modes of thermal coupling between the substrates 140 of the light radiation sources 14 and the circuit board 16, on the one hand, and the base wall 12*a* of the housing 12, on the other hand; in various embodiments, the characteristics of this coupling may if necessary be improved by using interface materials based on phase change materials, graphite, thermal adhesives, or the like.

Various embodiments may enable one or more of the following advantages to be obtained:

minimization of the dimensions of the light radiation sources, for example as regards the dimensions of the substrate on which the LED emitters are mounted, enhancement of the range of choices regarding the materials, including any necessary choices that are mutually optimized in terms of cost, performance, and process complexity, for example the possibility of combining an aluminum housing with ceramic substrates 140 so as to optimize the performance in terms of thermal resistance while also providing intrinsic robustness to electrostatic phenomena (ESD), improved reliability of the soldered joints (replaced by the conductive bridges 1800), especially as regards vibration resistance, reduction of the number of components, enhancement of the range of choices including those regarding the flexibility of use, with respect to the choice of the characteristics, dimensions and assembly conditions of the reflector or reflectors.

In various embodiments, it is possible to use optical elements (such as reflectors) 18 of aluminum-coated plastic material with a three-dimensional (3D) electrical configuration created directly on the reflector by the method known as MID (molded interconnect devices) which can be implemented by laser, chemical or plasma structuring techniques. A layout of the MID type can enable strip contacts to be connected to the connectors used to connect the reflector to the power supply cable 20 or to other reflectors. In various embodiments it is possible to use connectors and contacts embedded in the base part 180 of the reflector 18.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device comprising:

a tray-like housing having a base wall, at least one electrically powered light radiation source placed on the base wall of the housing with electrical contact pads in an opposite position from the base wall of the housing, a circuit board arranged on the base wall of the housing, the circuit board having a face opposite from the base wall of the housing and having electrically conductive lines extending thereon, the electrically conductive lines having respective electrical contact pads in positions facing the electrical contact pads of the at least one light radiation source, and at least one optical element having a light input to collect light radiation at said at least one light radiation source and at least one light output to project light radiation from the lighting device; the optical element having an electrically non-conductive base wall resting on the at least one light radiation source and the circuit board to urge the at least one light radiation source and the circuit board toward the base wall of the housing; the base wall of the optical element carrying electrical contacts to bridge the contact pads of the at least one light radiation source and the circuit board.

2. The lighting device as claimed in claim 1, wherein the tray-like housing includes metal material.

3. The lighting device as claimed in claim 1, wherein the optical element includes a body of plastic material.

4. The lighting device as claimed in claim 1, wherein the circuit board is in the form of a printed circuit board.

5. The lighting device as claimed in claim 1, wherein the circuit board includes anode and cathode power supply lines.

6. The lighting device as claimed in claim 1, wherein said light radiation source has a plate-like substrate, having at least one light radiation emitter, mounted thereon.

7. The lighting device as claimed in claim 1, wherein the circuit board is an elongate linear member.

8. The lighting device as claimed in claim 1, wherein the circuit board has at least one cut-out with said at least one light radiation source extending in said cut-out.

9. The lighting device as claimed in claim 1, wherein the at least one optical element includes a reflector having a light input aperture to collect light radiation at said at least one light radiation source and at least one light output aperture to project light radiation from the lighting device.

10. The lighting device as claimed in claim 2, wherein the tray-like housing includes aluminum.

11. The lighting device as claimed in claim 6, wherein the plate-like substrate is a ceramic or with a metal core.

12. The lighting device as claimed in claim 6, wherein the at least one light radiation emitter is an LED.

* * * * *

UNITED STATES PATENT AND TRADEMARK OFFICE

CERTIFICATE OF CORRECTION

PATENT NO. : 9,086,193 B2
APPLICATION NO. : 14/197264
DATED : July 21, 2015
INVENTOR(S) : Alberto Alfier et al.

It is certified that error appears in the above-identified patent and that said Letters Patent is hereby corrected as shown below:

In the specification

Column 5, line 60: Please write "14" between the words "sources" and "are".

Signed and Sealed this
Fifteenth Day of March, 2016

Michelle K. Lee

Michelle K. Lee
*Director of the United States Patent and Trademark Office*